US010694896B2

(12) United States Patent
Montero Pascual

(10) Patent No.: US 10,694,896 B2
(45) Date of Patent: Jun. 30, 2020

(54) FLAT SURFACE FOR SINKS AND SHOWER PANS WITH DRAINAGE BY MEANS OF CHANNELS

(71) Applicant: CNES. M. MONTERO PASCUAL, S.L., Segovia (ES)

(72) Inventor: Mariano Montero Pascual, Segovia (ES)

(73) Assignee: CNES. M. MONTERO PASCUAL, S.L., Segovia (ES)

( * ) Notice: Subject to any disclaimer, the term of this patent is extended or adjusted under 35 U.S.C. 154(b) by 0 days.

(21) Appl. No.: 15/573,589

(22) PCT Filed: May 10, 2016

(86) PCT No.: PCT/ES2016/070351
§ 371 (c)(1),
(2) Date: Nov. 13, 2017

(87) PCT Pub. No.: WO2016/181007
PCT Pub. Date: Nov. 17, 2016

(65) Prior Publication Data

US 2018/0064293 A1 Mar. 8, 2018

(30) Foreign Application Priority Data

May 14, 2015 (ES) ..... 201500487
Sep. 15, 2015 (ES) ..... 201531311

(51) Int. Cl.
*A47K 1/12* (2006.01)
*A47K 3/40* (2006.01)
(Continued)

(52) U.S. Cl.
CPC ..... *A47K 1/12* (2013.01); *A47K 3/40* (2013.01); *E03C 1/04* (2013.01); *E03C 1/12* (2013.01); *E03C 1/14* (2013.01); *E03C 1/30* (2013.01)

(58) Field of Classification Search
CPC .... A47K 1/12; A47K 3/40; E03C 1/04; E03C 1/12; E03C 1/14; E03C 1/30
(Continued)

(56) References Cited

U.S. PATENT DOCUMENTS 2,025,814 A * 12/1935 Goss ..... A47K 3/40 210/163
2,449,323 A * 9/1948 Richterkessing ..... A47K 3/40 4/613
(Continued)

FOREIGN PATENT DOCUMENTS

DE 8806743 U1 7/1988
DE 9017654 U1 10/1991
(Continued)

OTHER PUBLICATIONS

International Search Report for PCT/ES2016/070351 dated Aug. 8, 2016.

*Primary Examiner* — Lori L Baker
(74) *Attorney, Agent, or Firm* — Brown & Michaels, PC

(57) ABSTRACT

A flat surface for sinks and shower pans with drainage through channels, which, as a single component, has a flat upper surface (1) in which interconnected radial and peripheral channels (2) are made, which guide the water to a drain (3) arranged in the lower part thereof, and partial grooves (4) run between the channels (2), said grooves having a recess to prevent the water from spilling over, and this upper flat surface (1) is arranged over a concave water collection tray (5) which leads into the drain (3).

3 Claims, 5 Drawing Sheets

(51) Int. Cl.

| | |
|---|---|
| ***E03C 1/12*** | (2006.01) |
| ***E03C 1/04*** | (2006.01) |
| ***E03C 1/14*** | (2006.01) |
| ***E03C 1/30*** | (2006.01) |

(58) Field of Classification Search
USPC ..... 4/650
See application file for complete search history.

(56) References Cited

U.S. PATENT DOCUMENTS

| | | | | |
|---|---|---|---|---|
| 5,458,769 | A * | 10/1995 | Johannessen | E03F 5/0407 210/163 |
| 5,718,008 | A * | 2/1998 | Pane | A47K 3/40 210/163 |
| 6,178,571 | B1 | 1/2001 | McAllister | |
| 8,141,182 | B2 * | 3/2012 | Cook | A47K 3/40 4/613 |
| 2001/0052148 | A1 | 12/2001 | Hasenkopf | |
| 2006/0213006 | A1 * | 9/2006 | Rush, Jr. | A47K 3/40 4/613 |
| 2009/0320204 | A1 * | 12/2009 | Wiseman | A47K 3/40 4/613 |
| 2016/0174773 | A1 * | 6/2016 | Summers | A47K 3/40 4/613 |

FOREIGN PATENT DOCUMENTS

| | | | |
|---|---|---|---|
| DE | 19847204 | C1 | 3/2000 |
| DE | 29819329 | U1 | 4/2000 |
| DE | 10146874 | C1 | 10/2002 |
| DE | 10235367 | C1 | 10/2003 |
| EP | 1430185 | A1 | 6/2004 |
| ES | 2119556 | T3 | 10/1998 |
| ES | 1045026 | U | 7/2000 |
| ES | 1050210 | U | 3/2002 |
| ES | 1055672 | U | 1/2004 |
| ES | 2284597 | T3 | 11/2007 |
| GB | 2402059 | A | 12/2004 |

* cited by examiner

FLAT SURFACE FOR SINKS AND SHOWER PANS WITH DRAINAGE BY MEANS OF CHANNELS

SUBJECT MATTER OF THE INVENTION

The invention relates to a flat surface made of a single volume with a series of interconnected perforated channels on the surface wherein the lower level of these channels coincides with the connection to the drain. There is a peripheral channel connected at least to one point of the other channels.

BACKGROUND OF THE INVENTION

Up to now, the current state of the art includes different surfaces or shower pans or sinks in which the upper part is flat and can incorporate channels for water to run through and drains situated at different points. More specifically, the characteristics are detailed in the following documents:

Document GB2402059A (WEBB AK) discloses a sanitary apparatus, in this case a shower pan, specially designed for persons with a physical disability, even for persons who use wheelchairs. It is a shower pan with a flat surface that has a series of internal channels and a peripheral channel, all of which are interconnected. The water that falls onto the upper surface runs through the channels until reaching the drain.

Document DE19847204C1 (OBERMILLACHER R) discloses a sanitary apparatus of a shower pan with a flat upper surface. It has internal channels and a peripheral channel. The channels direct the water towards a lower concave tray and from there to the drain. It has a flat upper surface, drains through internal and peripheral channels, and drains towards a lower tray, which has a concave form.

Document DE10146874C1 (KLEIN J) describes a sanitary apparatus. In this case, it is a sink. It has a flat upper surface. On the flat surface there is a circular channel through which the liquid drains, which runs to a lower cavity in the form of a tray. This cavity drains by means of two drainage tubes. This sanitary apparatus is designed as a sink.

Document DE10235367C1 (MARTINEZ MS) describes a basin with a flat upper surface onto which water falls. It has a peripheral groove for draining the liquid which connects to a lower cavity, in the form of a flat tray, and which in turn diverts the water towards a central drainage pipe.

Document DE9017654U1 (ARTEFAAKT INDUSTRIE-DESIGN) describes a shower element with a peripheral channel that incorporates a drain outlet. The channel is sloped to aid in the drainage. It does not have internal channels.

Document ES2284597T3 (BELDORE LTD) describes a shower pan. It has a flat upper surface with a peripheral channel connected to a drain.

Document ES2119556T3 (GRAELLS PANE) describes a shower pan with a flat upper surface. It has a channel on one side of the shower pan through which water runs until reaching a drainpipe at one of the corners.

Document DE8806743U1 (ROOS) describes a shower pan. In this case the flat surface on the ground level is made of plastic or metal, being an anti-slip perforated surface. The water reaches a lower tray through the perforations and is carried out by means of a lower drain.

Document DE29819329U1 (KRAJEWSKI) describes a shower pan for persons with limited mobility. The shower pan is situated flush with the floor to facilitate entrance to the area. It has a flat surface flush with the floor and a peripheral water-collecting channel. The water runs towards a tray and then to the drain.

None of the aforementioned patents has the characteristics claimed in the present invention since they were not manufactured from a single component and in a way that the channels themselves act as a grate to prevent large objects from entering the drain which may cause the drain to become clogged.

DESCRIPTION OF THE INVENTION

The invention relates to a flat surface for sinks and shower pans with drainage by means of channels, which basically consists of a single volume of stone, concrete, or any other construction material that is flat on the upper part thereof and in which there are channels which radially connect to a drain arranged in the lower part thereof.

These channels may be made by means of a radial arm saw or any other cutting technique, such as laser, water injection, etc., and has a thickness small enough to allow water to pass through, yet at the same time preventing objects from entering that could clog the drain. This characteristic of the thickness of the channels allows them to act as grates which are placed on drains of sinks, bathtubs or showers. The channels also have a greater depth the closer they are to the drain in order to facilitate water drainage.

On the lower part is a drain made in the volume and into which the upper channels drain.

Partial grooves run between the channels, said grooves having a recess to prevent the water from spilling over. The upper flat surface is arranged over a concave water collection tray which leads into the drain.

All of these parts of the invention are made as a single component, thereby making it unnecessary to interconnect or join different components, in addition to substantially reducing production costs.

DESCRIPTION OF THE DRAWINGS

As a complement to the description provided herein, and for the purpose of helping to make the characteristics of the invention more readily understandable, the present specification is accompanied by figures constituting an integral part of the same, which represent the following.

PREFERRED EMBODIMENT OF THE INVENTION

Figure 1:
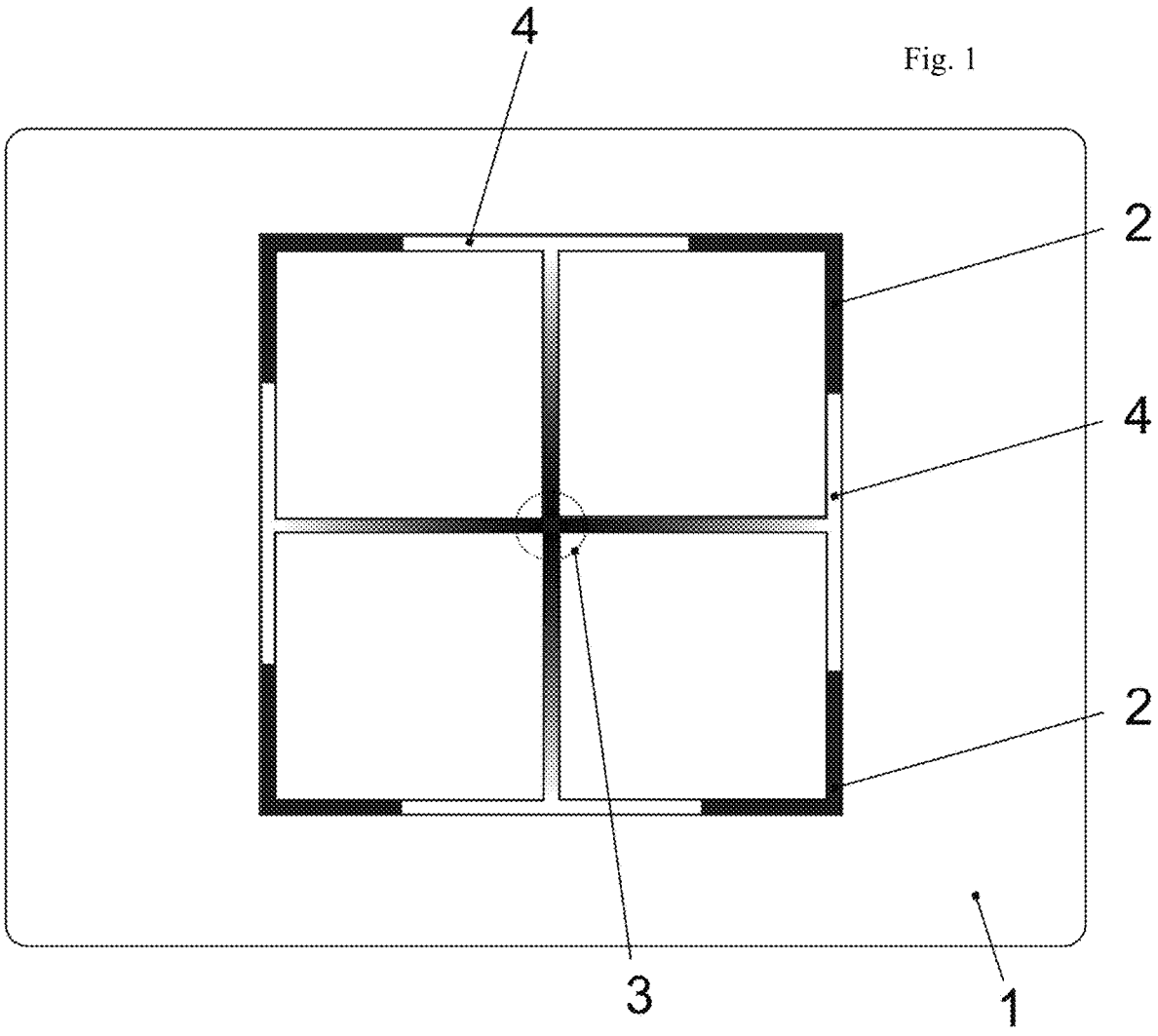
FIG. 1 shows a top view in which the block with the channels that dump into the drain can be seen.
Figure 2:
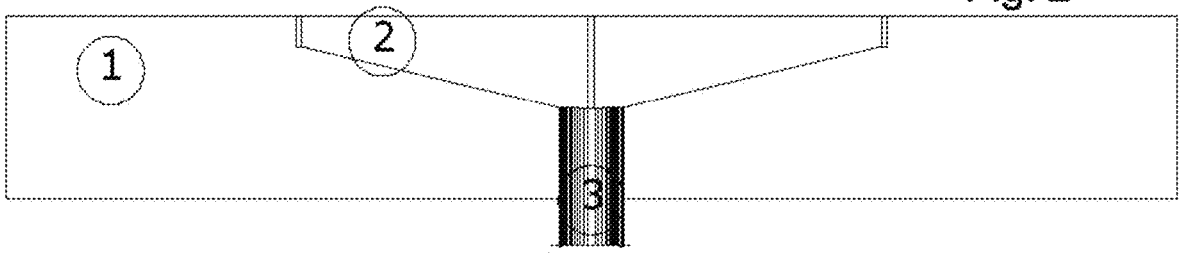
FIG. 2 shows a view of a section at the center point of the drain and longitudinal to a channel that dumps into this drain.
Figure 3:
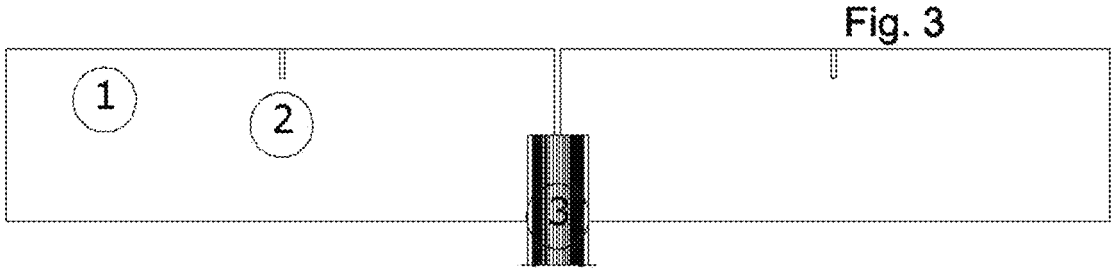
FIG. 3 shows a view of a section at the center point of the drain different to that into which the channel dumps.

With reference to FIGS. 1 to 8, the flat surface for sinks and shower pans with drainage by means of channels consists of a block with a flat surface (1) in which in the upper part thereof channels (2) are made which radially dump the water into a drain (3) made in the lower part thereof. The channels (2) pass through the entire volume to the area of the lower part where the drain (3) is situated in order to dump the water into the same. Partial grooves (4) run between the channels (2), said grooves (4) having a recess to prevent the water from spilling over. The upper flat surface (1) is arranged over a concave water collection tray (5) which dumps into the drain (3).

Figure 4:
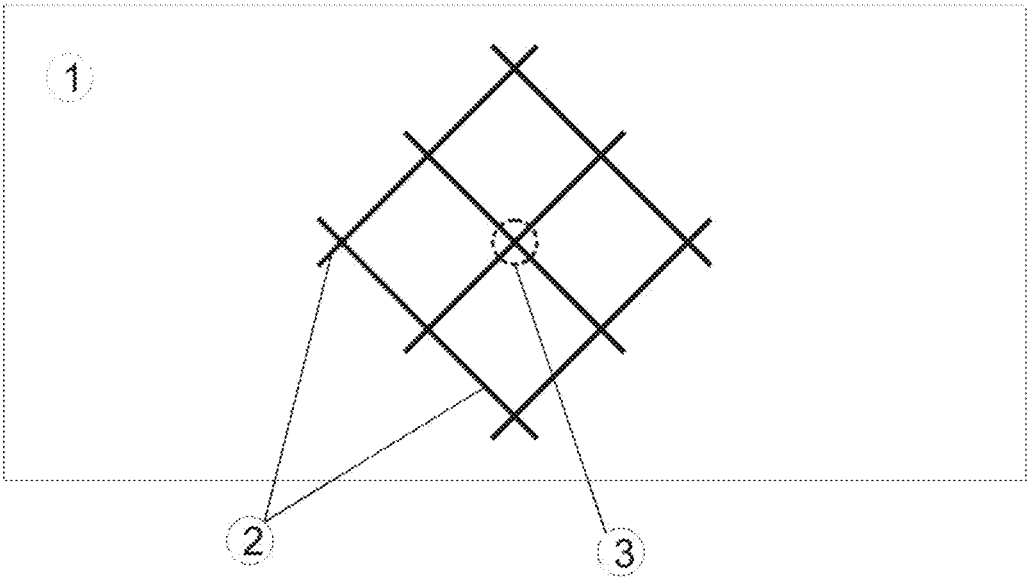
FIG. 4 shows a top view of the flat surface in which the channels are turned 45° with respect to the sides of the flat surface and intersect at the vertices and at the sides.

The channels (2) that dump into the drain (3) are interconnected with the other peripheral channels and, as can be seen in FIG. 4 of another preferred embodiment, they intersect at the sides and at the vertices. This way the embodiment of the same is substantially facilitated when cuts in the stone or concrete block are made by means of a radial arm saw.

Figure 5:
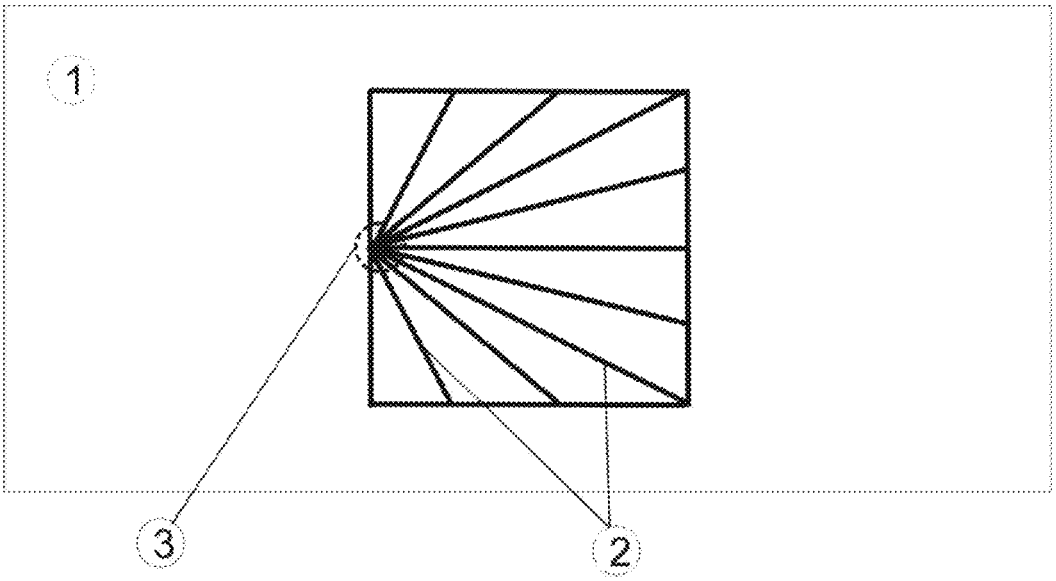
FIG. 5 shows a top view of the flat surface in which the drain of the lower part is not centered with respect to the peripheral channels but is rather on a side but with the radial channels dumping the water into the same.
Figure 6:
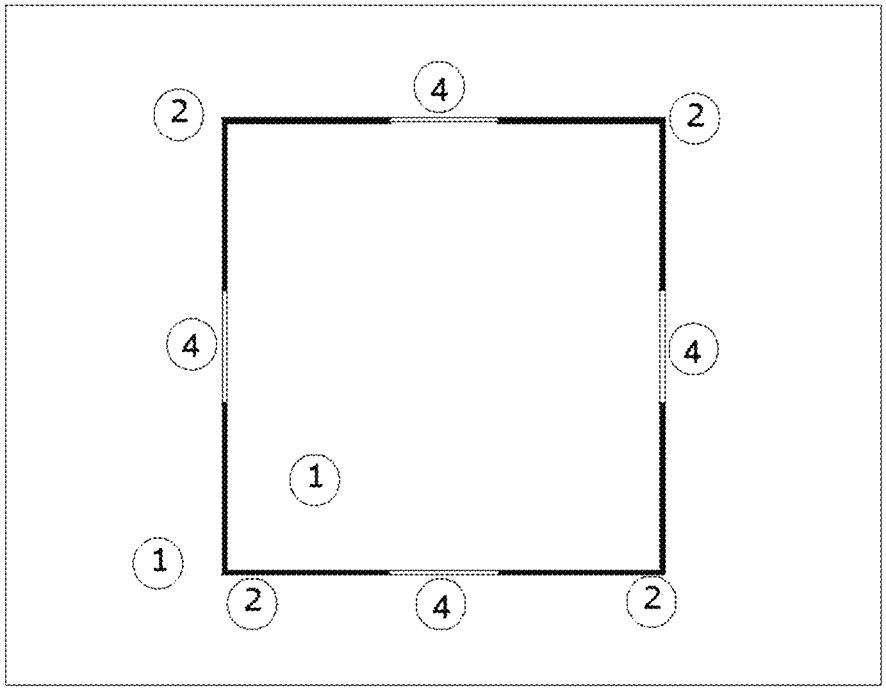
FIG. 6 shows a top view in which the block with the channels that dump into the drain can be seen.
Figure 7:
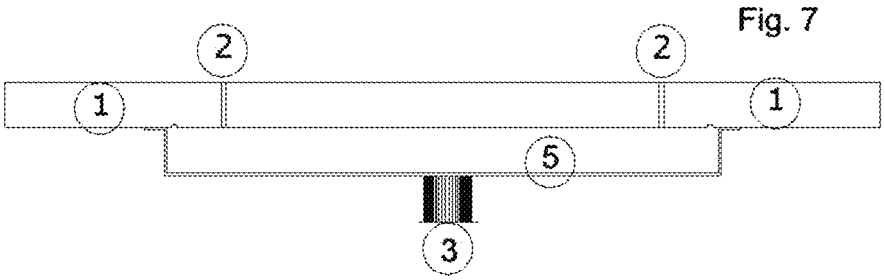
FIG. 7 shows a view of a section of a center point of the drain in which the channels dump into the collection tray.
Figure 8:
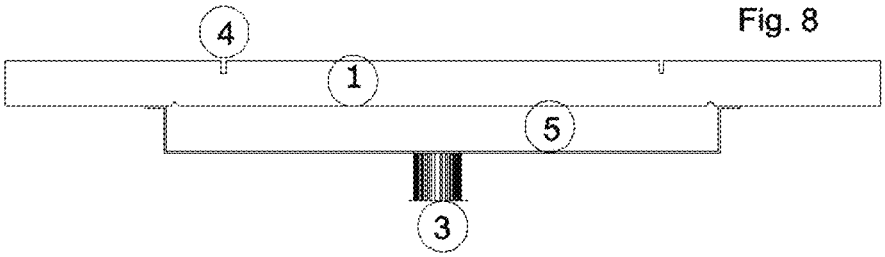
FIG. 8 shows a view of a section of a point in which the partial grooves can be seen.

Another preferred embodiment is shown in FIG. 5, wherein the drain (3) of the lower part is situated on a side, under the area of the peripheral channels, with the radial channels (2) dumping the water into the same.

Having sufficiently described the nature of the present invention, in addition to an example of implementation, it must be added that the shape and materials of said invention may be modified, provided that it does not imply altering the characteristics claimed below.

The invention claimed is:

1. A block with an upper flat surface for sinks and shower pans with drainage comprising a plurality of radial channels interconnected with peripheral channels located throughout a periphery of the upper flat surface, wherein the peripheral and the radial channels intersecting partial grooves both at a peripheral part of the upper flat surface and at vertices of the radial channels and peripheral channels in the upper flat surface characterized in that the partial grooves do not pass through the entire block, the radial channels having a thickness between 0.2 and 1 cm, characterized in that at least a portion of one of the radial and peripheral channels pass through the block to an area where a drain is situated below the block in order to drain water.

2. The block in accordance with claim 1, wherein the block is arranged on a concave water collection tray which empties into the drain, and the peripheral channels are discontinuous, and are interconnected with at least one channel that includes a partial groove that does not pass through the entire block.

3. The block in accordance with claim 1, wherein the peripheral channels interconnect with the radial channels at a depth of the radial channels nearest to the upper flat surface and wherein the radial channels have a greater depth the closer they are to the drain in order to facilitate water drainage.

* * * * *